United States Patent [19]

Bonsack

[11] 4,041,693

[45] Aug. 16, 1977

[54] ESCAPEMENT FOR A TIMEPIECE

[75] Inventor: François Bonsack, Le Locle, Switzerland

[73] Assignee: Les Fabriques d'Assortiments Reunies, Le Locle, Switzerland

[21] Appl. No.: 615,111

[22] Filed: Sept. 19, 1975

Related U.S. Application Data

[63] Continuation of Ser. No. 390,343, Aug. 22, 1973, abandoned.

[30] Foreign Application Priority Data

Sept. 1, 1972 Switzerland ..... 12907/72

[51] Int. Cl.[2] ..... G04B 15/00

[52] U.S. Cl. ..... 58/116 R; 58/117; 74/1.5

[58] Field of Search ..... 58/116 R, 28 R, 28 D, 58/117; 74/1.5, 575, 577 M

[56] References Cited

U.S. PATENT DOCUMENTS

| | | | |
|---|---|---|---|
| 1,327,226 | 1/1920 | De Long | 74/1.5 X |
| 3,628,327 | 12/1971 | Abe | 58/116 R |

OTHER PUBLICATIONS

W. J. Gazeley, "Clock and Watch Escapements", London, Heywood & Co. Ltd., 1956, pp. 45–49.

*Primary Examiner*—Ulysses Weldon
*Attorney, Agent, or Firm*—Imirie, Smiley & Linn

[57] ABSTRACT

This invention refers to a high efficiency escapement wherein the pallets embrace more than one fifth of the teeth of the pallets wheel, and wherein the entry-pallet embraces relative to the line joining the center of the escape wheel to the pallet staff at least one tooth more of said wheel than the exit-pallet relative to said joining line.

2 Claims, 9 Drawing Figures

ESCAPEMENT FOR A TIMEPIECE

This is a continuation, application No. 390,343, filed Aug. 22, 1973 now abandoned.

BACKGROUND OF THE INVENTION

This invention refers to an escapement for a timepiece, especially to a high efficiency escapement.

The escapement of a watch has the purpose of transmitting the energy of the gear train, i.e. of the mainspring (motor spring) to the balance which acts as a rate regulator. It is known in the traditional watch-making technique that the accuracy of the rate of a timepiece and specially the sensitivity against external disturbances are correlated to the stored energy of the system spring balance. This energy depends on many factors, for instance on the efficiency of the gear train, on the efficiency of the escapement and on the quality of the oscillator itself. It is important to know that the total efficiency of the escapement can be divided in both an efficiency escape wheel-pallets and pallets-balance.

Generally it can be admitted that in timepiece movements of modern design the efficiency of the gear train is more or less optimalized.

This is also true for the efficiency of the pallets-balance, because at the joint fork — roller-pin the impulse is given in direction of the movement. The efficiency of the oscillator himself can also be considered as good.

This is not the same with the efficiency of the escape wheel-pallets, so that working on its improvement amounts to an increase of the quality of the rate of the watch.

SUMMARY OF THE INVENTION

It is the aim of the present invention to realize an escapement with an increased total efficiency, where particularly the partial efficiency between escapement wheel and pallets is increased compared to known escapements.

This new escapement must be adaptable in high quality watches, wherein the pallets should have palletstones of ruby or hard-coated metal.

This goal is attained with an escapement wherein the pallets embrace more than a fifth of the teeth of the escape wheel, and wherein the entry-pallet embraces, relative to the line connecting the center of the escape wheel and the pallet staff at least one tooth more of said wheel than the exit-pallet relative to said connecting line.

In an advantageous embodiment the means inclination of the pallets corresponds nearly to the theoretical optimum value.

For better understanding this invention and the advantages relative to a conventional escapement, it is necessary to develop in a broad outline the theory of the working of an escapement and to calculate the optimization of its efficiency with the aid of the drawings.

DETAILED DESCRIPTION OF THE INVENTION

Figure 1:
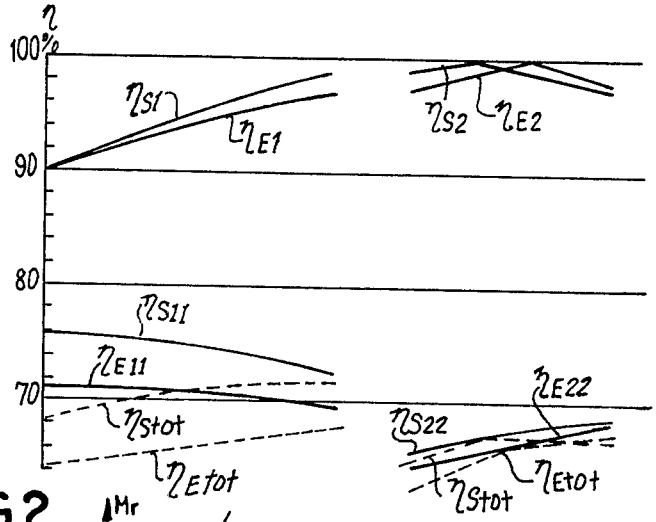
FIG. 1 shows the transient efficiency of the transmission of force by tooth-pallet and fork-roller-pin during two phases of an impulse.

The disturbance in the rate of a watch, ($\Delta T$,/T) due to a moment C which acts on the watch, where the elongation of the balance is $\frac{1}{4}$, can be computed from the formula of Airy:

$$\frac{\Delta T}{T} = \frac{1}{4\pi W} \int_{\Phi = 0}^{\Phi = 2\pi} C\,\theta\, d\Phi \qquad (1)$$

wherein W is the total energy of the oscillator.

This formula shows that the influence of a disturbance on the rate of a watch, generated either by the friction of the pivots, by the escapement or otherwise, is smaller the greater is W. Therefore, one has an interest to increase this value by increasing either the moment of inertia of the balance or the frequency. But for this increase in energy there is a drawback: in order to increase the moment of inertia it is necessary to have a larger mass which increases the friction of the pivots. On the other hand an oscillator with a higher frequency has more losses of energy by friction, as the velocity and the covered path increase. That means, an oscillator with higher energy has more losses. Besides, the energy which can be stored in a watch is limited by the volume of the barrel and by the necessary power-reserve. Therefore, it is advantageous to search for better use of available energy and for reducing the losses. One has to try a. to reduce the energy dissipated by the balance without diminshing the stored energy or b. to increase the efficiency of the gear train and the escapement, that means to increase the part of energy which is effectively transmitted from the spring to the balance.

In the following only the second problem will be discussed, that is how to increase the efficiency of the escapement and particularly the transmission of energy between the pallets wheel and the pallets.

The efficiency of the escapement can be defined as the ratio of the energy effectively received from the balance to the energy delivered from the escape wheel. The work effectuated by the escape wheel is easily determined by multiplying its couple with the covered angle. The balance receives during the impulse a certain amount of energy, but furnishes work to the pallets and escape wheel when unlocking. To increase the efficiency it is either necessary to reduce the extracted energy during the unlocking or to increase the energy furnished during the impulse.

The first method is not realistic: the energy extracted during the unlocking depends on the draw, but the correct working of the escapement needs a certain draw, which cannot be lowered. Later on will be shown that a lowering of the draw results only in a small advantage which is less important than the advantage resulting from reducing the drop. It follows that it is necessary to consider the energy transmitted during the impulse and how to increase this proportion.

One first mentioned way is reducing the drop. Measures have shown that a reduction of the drop of 0.01 mm or 1° increases the efficiency by 1.6%, whereas a reduction of the draw of 1° increases the efficiency only by 0.3%.

On the other hand a reduction of the drop creates problems: The industry is trying more and more to avoid correction during the escapement-making, in particular it is required that by mass production techniques work without correction.

If the tolerances as the drop, the blacklash etc. are restricted the number of pieces to be corrected will increase.

Even if the reducton of the drop is a good means to increase the efficiency it has a limit, so that the increase would amount to about 1 to 2%.

Therefore to increase the efficiency of the escapement the only way left is to improve the conditions of energy transfer between the pallets wheel and the pallets.

For the following considerations it can be admitted that the transfer of energy by impact is nearly the same as by gliding. This can be shown by calculation and these considerations are rigorous for the transient efficiency. When the transient efficiency for all phases of a function increases, the overall efficiency will increase too. Consequently there will be the tendency to increase the transient efficiency of the escapement, if the resulting conditions do not reduce the efficiencies of other phases.

During a short time $\Delta t$ the escapement wheel produces work of which a part is effectively received by the balance. The transient efficiency is the ratio of this effectively absorbed energy to that produced, when $\Delta t$ tends to zero. Let be, $\rho$ the angle by which the escapement wheel turns,
$\theta$ the angle by which the pallets turn, and
$\Theta$ the angle by which the balance turns and
C the torque of the escapement wheel,
$\gamma$ the torque of the pallets, and
96 the torque of the balance.

With this it is possible to define four transfer ratios:

$$l = \frac{d\theta}{d\Theta} \quad \frac{\text{angle balance}}{\text{angle pallets}} \qquad m = \frac{\gamma}{\Gamma} = \frac{\text{torque pallets}}{\text{torque balance}}$$

$$\lambda = \frac{d\rho}{d\Theta} = \frac{\text{angle wheel}}{\text{angle pallets}} \qquad \mu = \frac{\gamma}{C} = \frac{\text{torque pallets}}{\text{torque wheel}}$$

| | |
|---|---|
| The energy received from the balance is | $\Gamma d\theta$ |
| The energy furnished by the wheel is | $Cd\rho$ |
| At the pallets we have | $\gamma d\Theta$ |

The efficiency wheel-pallets $\eta_1$ is given by $$\eta_1 = \frac{\gamma d\Theta}{Cd\rho} = \frac{\mu}{l}$$

The efficiency pallets-balance $\eta_2$ is given by $$\eta_2 = \frac{\Gamma d\theta}{\gamma d\Theta} = \frac{l}{m}$$

The overall efficiency escape wheel-balance is thus $$\eta_{tot} = \eta_1 \cdot \eta_2 = \frac{\mu \cdot l}{\lambda \cdot m}$$

These relations allow an analysis of the development of the efficiency during the impulse and to determine the parts played by the two force transmissions, wheel-pallets and pallets-balance, as it can be seen in the diagram of FIG. 1. In the superior part of this diagram are the graphs $\eta_{S1}$, $\eta_{E1}$, $\eta_{S2}$, $\eta_{E2}$, which show the respective efficiency roller pin-pallets fork at the entry and at the exit during the first and second phase of the impulse and in the lower part the graphs $\eta_{S\,11}$, $\eta_{E\,11}$, $\eta_{S\,tot}$ and $\eta_{E\,tot}$ which represent the respective efficiency toothpallet and the total efficiency wheel-balance during the first phase of the impulse at the exit and at the entry. In the lower right part of the diagram one sees the graphs $\eta_{S\,22}$, $\eta_{E\,22}$, $\eta_{S2\,tot}$ and $\eta_{E2\,tot}$, $\eta_{tot}$ which represent the respective efficiency tooth-pallet at the entry and at the exit and the total efficiency wheel-balance at the exit and at the entry during the second phase of the impulse It follows that the efficiency $\eta$ represented on the ordinate in percent, is better at the joint pallets fork-roller pin than at the joint tooth-pallet, better at the exit than at the entry, and better in the first phase of the impulse where the heel of the tooth rubs against the impulse-face of the pallet than in the second phase where the point of the pallet rubs against the impulse-face of the tooth. It is possible to compute the efficiency from the transfer ratios, but these ratios depend from geometrical values of the escapement.

Figure 2:
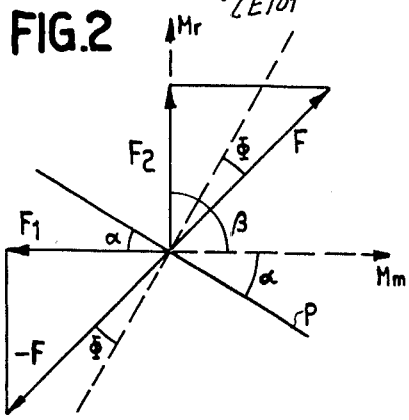
FIG. 2 is a diagram of the transmission of the forces by inclined planes.

It would therefore be an advantage to have a simple formula which describes the efficiency as function of certain geometrical values, so that one can increase the efficiency changing these geometrical values. Therefore the efficiency of a transmission by inclined planes has to be examined first, e.g. between the excapement wheel specifically the pallets. The tooth which moves in a certain direction has to push the pallets in a direction which is about perpendicular to the first direction. This change in the direction is obtained by an inclined plane P, as shown in FIG. 2. On the absicissa we have the direction of motion of the motor Mm and the direction of motion of the receiver Mr on the ordinate, and the angle $\beta$ between Mm and Mr p1 the angle $\alpha$ between the inclined plane P and Mm
the angle of friction $\Phi$, which is defined as $$\tan \Phi = \frac{\text{force of friction}}{\text{force of application}}$$

The forces F, F′, existing between the two plane — of the tooth and of the pallet — are opposite and equal, whereby their direction is displaced by the angle $\Phi$ in the direction of movement, as shown in FIG. 2. The work $A_1$ performed by the motor organ, specificallly by the tooth 12 of the escape wheel M, FIG. 9, is the product of the displacement $d_1$ of M with the projection $F_1$ of F opposing of this movement:

$$A_1 = d_1 \cdot F_1 = d_1 \cdot F_1 \cos(90° - \Phi - \alpha) = d_1 \cdot F \sin(\alpha + \Phi)$$

Figure 9:
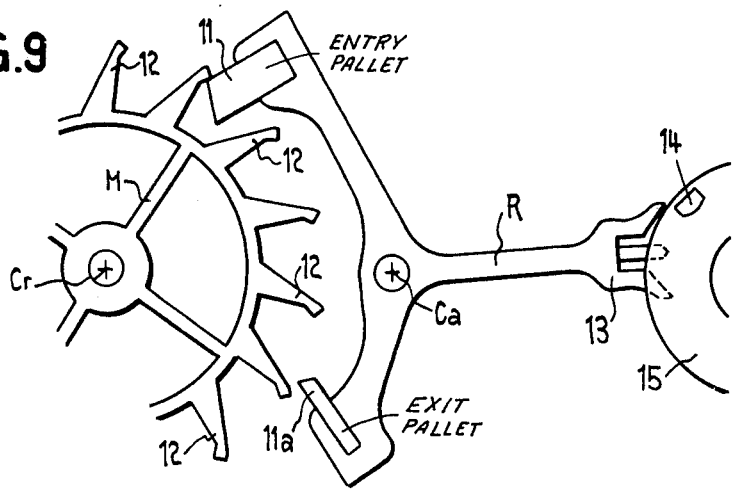
FIG. 9 is an embodiment of the new escapement according to the present invention.

The work $A_2$, taken up by the receiver, specifically the pallet 11 of the pallets R, FIG. 9, is the product of the displacement $d_2$ of R with the projection $F_2$ of F in the direction of this movement:

$$A_2 = d_2 \cdot F\cos(\alpha+\beta-90^\circ+\Phi) = d_2 \cdot F\sin(\alpha+\beta+$$

Figure 3:
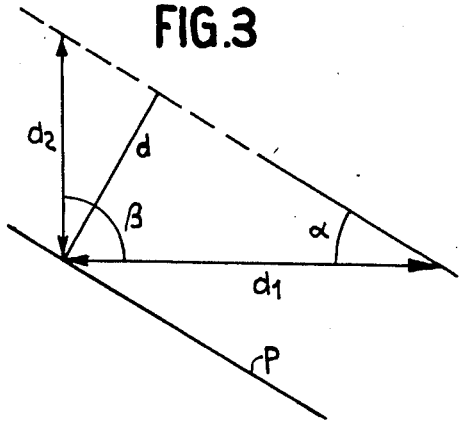
FIG. 3 is a diagram of the transmission of the motion by an inclined plane.

The displacement $d_1$, $d_2$, $d$ are shown in FIG. 3. Thus we have for the efficiency $$\eta = \frac{A_2}{A_1} \text{ with}$$

$$d_1 = \frac{d}{\sin\alpha} \text{ and } d_2 = \frac{d}{\cos(\alpha+\beta-90^\circ)} = \frac{d}{\sin(\alpha+\beta)}$$

(see FIG. 3)

$$\eta = \frac{\sin(\alpha+\Phi+\beta)\cdot\sin\alpha}{\sin(\alpha+\Phi)\cdot\sin(\alpha+\beta)}$$

Figure 4:
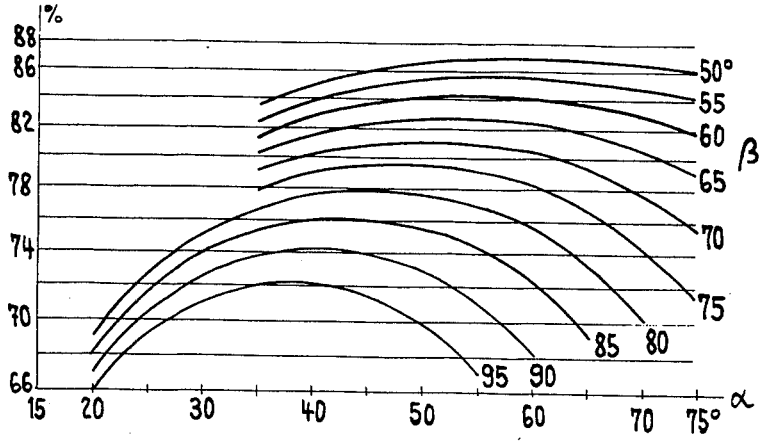
FIG. 4 is a diagram of the efficiency of a transmission of force by an inclined plane for a friction coefficient of 0:15 as a function of the inclination and the angle of the transmission of forces as parameters.

For a given angle of friction $\Phi$, $\beta$ is a function of two variables, $\alpha$ and $\beta$; which are represented in FIG. 4, where the efficiency of the transmission is plotted on the ordinate as a function of the inclination of plane P on the abscissa and that for different angles of transmission of force, which are indicated as a parameter.

Figure 5:
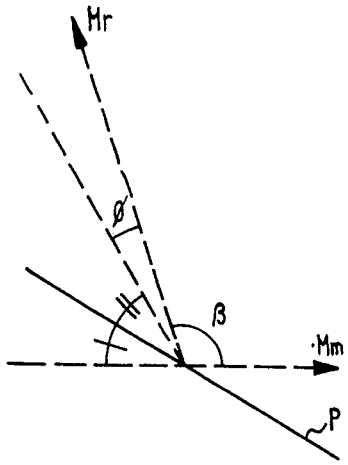
FIG. 5 is a diagram of the theoretical optimal inclination of the planes.

It can be stated:

a. There exists an optimal inclination of plane P for each angle of transmission of the force. The optimum can be found, if the plane P, as shown in FIG. 5, is parallel to the bisecting line of the angle which together with $\beta+\Phi$ subtends an angle of 180° or $\pi$ with respect to the direction of Mm, that is

$$\alpha = \alpha \text{ optimal} = \tfrac{1}{2}(\pi-\beta-\Phi).$$

Figure 6:
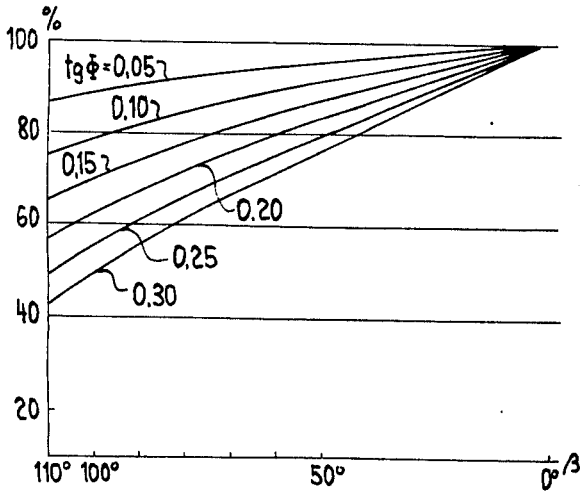
FIG. 6 is a diagram of the efficiency for the optimal inclination as a function of the angle of the transmission of force and the coefficient of friction, tg $\Phi$.
Figure 7:
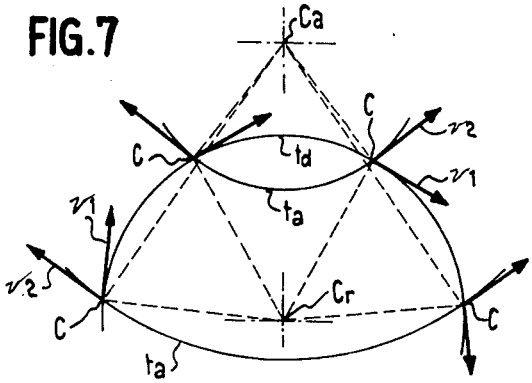
FIG. 7 is a diagram of the angle of transmission of force as a function of the position of the pallets relative to the connecting line center escape wheel-pallet staff.
Figure 8:
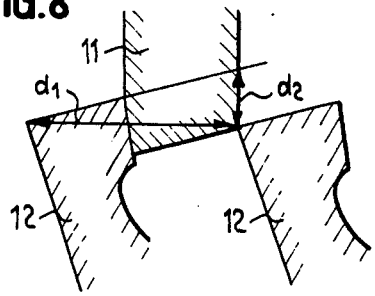
FIG. 8 is a diagram which indicates the dependency of the means inclination from the path the wheel follows and the portion the pallets are covering.

The function is symmetric to the optimum, so that the losses of efficiency are equal, if the deviation from this optimum is positive or negative.

b. The efficiency is higher, the smaller the angle of transmission B, which could be anticipated, because when the two parts have the same direction they can not rub against each other, the losses vanish and the efficiency becomes 100 %. This is demonstrated in FIG. 6 which shows some graphs for different angles of friction $\Phi$ as a function of the angle of transmission $\beta$. From this follows that if it is wanted to increase the efficiency $\eta_1$ and hence the total efficiency $\eta$ tot of the escapement, it is necessary according to FIG. 7.

a. to obtain that the pallets cover a trajectory $t_a$ which has at the contact point C with the tooth 12 of wheel M a smallest possible angle with the trajectory $t_d$ of tooth 12. This can be obtained by moving the entry pallet 11 further off from center Ca and by drawing nearer to enter Ca the exit pallets 11*a*, so that when work is being performed the directions of the pallets 11 and 11*a* shown by vectors $V_2$ as near as possible in the direction of vectors $V_1$ of the tooth 12. In this manner, the angle between vectors $V_1$ and $V_2$ is minimized for both entry and exit pallets. This shows a way to realize an escapement with a high efficiency $\eta_1$. The new escapement is drawn following this general rule.

b. The inclination of plane P should, for a given angle of transmission, approach the theoretical optimum as much as possible. In the usual escapement the inclination of the impulse planes relative to the tangent at the pallets wheel is too small, especially at the entry and for the inclination of the wheel. This explains the relatively low efficiency which could be observed at the entry and in the second phase of the impulse. The new escapement takes into account these facts. Experiments have shown that the angle of the inclined plane P should be within the limits of ± 5° of the theoretical value. Nevertheless, the inclination cannot be easily increased because it must satisfy certain conditions: when the wheel covers a distance which corresponds to a tooth less the drops, the pallet has to cover the lift to and fro. The mean inclination is approximated, as can be seen in FIG. 8, by the distance $d_2$ which the pallets, specifically the pallet 11 is covering and by the distance $d_1$ which the wheel, specifically the tooth 12 is covering. To increase the mean inclination it is necessary to increase the distance $d_1$ of the pallets or to reduce the distance $d_1$ of the wheel. To reduce the distance $d_1$ by reducing the diameter of the wheel or increasing the number of teeth is not a suitable way, because in order to conserve a identical linear drop it is necessary to increase the angular drop, thus losing probably more than could be gained.

To increase of the distance $d_2$ of the pallets seems to be more advantageous. In the new escapement the lift was not increased, but the embracement between the pallets was increased from 2 ½ to 3½ teeth, which draws away the two pallets from the center Ca of the pallets (FIG. 7), whereas the distance $d_2$ grows for the same angle. Because on the other hand, to improve the angle of transmission, the entry pallet 11 has to be moved away and the exit pallet 11*a* drawn nearer, the angle covered from pallets R is greater at the entry than at the exit. Further, to obtain correct inclinations the wheel has to cover unlike paths, a greater one at the entry and a smaller one at the exit, which leads to pallet-stones with different width. FIG. 9 shows as a non limitative example an escapement which was drawn according to the described principles, which transient theoretical efficiency is markedly improved relative to a conventional escapement. There is in particular the motor organ M, which is formed as a pallets wheel and the receiver R, in form of a pallets, whereas both turn around their respective axes, Cr and Ca. The escape wheel carries the teeth 12, which transmit the energy of the impulse to the pallets 11 and 11*a* of pallets R, which in turn transmits it with the aid of its fork 13 to the balance, specifically to the roller pin 14 of the table roller 15 of the balance. When comparing the computed values for a conventional escapement with those of the new escapement, it follows that there exists a substantial higher efficiency for the latter. The values in the following table relate to escapements with a distance wheel-pallets of 3.15 mm and pallets wheel diameter of 4.85 mm, whereas the wheel had 15 teeth.

| Phase of transmission | | | Usual escap. | Average | New escap. | Average | Rel. increase |
|---|---|---|---|---|---|---|---|
| Entry | Impulse first phase | Start | 71,4 % | | 80 % | | |
| | | | | 70,5 % | | 79 % | + 12 % |
| | | End | 69,6 % | | 78 % | | |

-continued

| Phase of transmission | | | Usual escap. | Average | New escap. | Average | Rel. increase |
|---|---|---|---|---|---|---|---|
| Exit | Impulse second phase | Start | 64,8 % | | 77 % | | |
| | | | | 66,6 % | | 77 % | + 15,6 % |
| | | End | 68,5 % | | 77 % | | |
| | Impulse first phase | Start | 75,8 % | | 82 % | | |
| | | | | 74,1 % | | 80 % | + 8 % |
| | | End | 72,5 % | | 78 % | | |
| | Impulse second phase | Start | 65,8 % | | 77 % | | |
| | | | | 67,2 % | | 77 % | + 14 % |
| | | End | 68,7 % | | 77,5 % | | |
| Weighted Mean Value | | | | 69,9 % | | 78,6 % | + 12,5 % |

The weighted mean value was computed as function of the angle the wheel covered during the respective phases. It results that the efficiency is improved theoretically by 12.5 % when considering only the transmission of energy between wheel and pallets. To obtain the total efficiency of the escapement it would be necessary to substract the losses for the unlocking and the drop and to consider the friction of the pinions. The applicant has measured the efficiency of an escapement with 21 teeth and has found at the same frequency an increase of the efficiency compared to an escapement of 15 teeth, with the same drop. This can be explained thus: as the pitch was reduced, the inclination had to be increased, so that the mean efficiency, computed after the same method as in the table, gives 72.7 % against 69.9 %. Furthermore the applicant has realized an escapement according to FIG. 9 and measured the efficiency. It follows that the improvement of the efficiency for an amplitude between 320° and 220° is about 9 % compared to a usual escapement. This means that the agreement with the theoretical value is good.

What is claimed is:

1. An escapement for a timepiece comprising an escape wheel having a plurality of teeth, and a pallet arm having entry and exit pallets disposed for cooperation with said teeth, said pallet arm being rotatable about an axis, and wherein a first line connecting the center of the entry-pallet to the center of the escape wheel defines an angle relative to a second line connecting the center of the escape wheel to the pallet axis, which angle embraces at least one tooth more of said wheel than the corresponding angle of the center of the exit-pallet relative to said second line, the angle $\beta$ between the direction of movement of said teeth and the direction of movement of said pallets being acute for both said entry-pallet and said exit-pallet, and the inclination of the pallet faces being substantially equal to $\frac{1}{2}(\pi-\beta-\phi)$, where $\pi=$ 180° and $\phi=$ the angle of friction between said teeth and said pallets.

2. An escapement for a timepiece comprising an escape wheel having a plurality of teeth, and a pallet arm having entry and exit-pallets disposed for cooperation with said teeth, said pallet arm being rotatable about an axis, and wherein a first line connecting the center of the entry-pallet to the center of the escape wheel defines an angle relative to a second line connecting the center of the escape wheel to the pallet axis, which angle embraces at least one tooth more of said wheel than the corresponding angle of the center of the exit-pallet relative to said second line, the angle $\beta$ between the direction of movement of said teeth and the direction of movement of said pallets being acute for both said entry-pallet and said exit-pallet, and the inclination of the teeth faces being substantially equal to $\frac{1}{2}(\pi-\beta-\phi)$, where $\pi=$ 180° and $\phi=$ the angle of friction between said teeth and said pallets.

* * * * *